United States Patent [19]

Kaieda

[11] Patent Number: 4,779,119

[45] Date of Patent: Oct. 18, 1988

[54] GROOVED CLEANING BLADE WITH END SEALS

[75] Inventor: Shozo Kaieda, Nagano, Japan

[73] Assignee: Kentek Information Systems, Inc., Allendale, N.J.

[21] Appl. No.: 35,978

[22] Filed: Apr. 8, 1987

[51] Int. Cl.[4] ..... G03G 21/00; G03G 15/06; A46B 15/00

[52] U.S. Cl. ..... 355/15; 15/256.5; 118/652; 430/125

[58] Field of Search ..... 355/3 DD, 3 DR, 10, 355/15, 3 R; 15/256.5, 256.51, 256.52, 256.53, 388; 118/652, 653; 430/125

[56] References Cited

U.S. PATENT DOCUMENTS

| | | | |
|---|---|---|---|
| 3,759,220 | 9/1973 | Saito et al. | 430/125 X |
| 3,848,992 | 11/1974 | Smith | 355/15 |
| 3,976,375 | 8/1976 | Kurita et al. . | |
| 4,211,484 | 6/1980 | Iwai et al. | 355/15 |
| 4,329,044 | 5/1982 | Kitajima et al. | 355/15 |
| 4,396,276 | 8/1983 | Murasaki | 430/125 X |
| 4,400,082 | 8/1983 | Kiba | 355/15 |
| 4,514,480 | 4/1985 | Wada et al. . | |
| 4,568,175 | 2/1986 | Inowa et al. . | |
| 4,571,070 | 2/1986 | Tomita . | |

FOREIGN PATENT DOCUMENTS

| | | | |
|---|---|---|---|
| 76875 | 5/1983 | Japan | 355/15 |
| 26772 | 2/1984 | Japan | 355/15 |
| 95553 | 6/1984 | Japan | 355/3 DD |
| 155877 | 9/1984 | Japan | 355/15 |
| 122681 | 11/1984 | Japan | 355/15 |

*Primary Examiner*—A. T. Grimley
*Assistant Examiner*—Ed Pipala
*Attorney, Agent, or Firm*—Marmorek, Guttman & Rubenstein

[57] ABSTRACT

A cleaner unit is disclosed with a rubbery elastic cleaning blade. The blade extends horizontally from an upright base member, where the cleaning edge contacts a vertically downward passing photoconductive surface such that toner scraped from the surface travels over the upper face of the blade without causing a toner cloud. The removed toner is guided over this upper surface of the cleaning blade through the use of seals along the cleaning blade edge and outside the image carrying area of the photoconductive surface, as well as through the use of toner guiding grooves between the end seals.

9 Claims, 4 Drawing Sheets

GROOVED CLEANING BLADE WITH END SEALS

BACKGROUND OF THE INVENTION (1) Field of the Invention

The present invention relates to a cleaning apparatus for removing toner remaining on a charge image retentive member such as photosensitive member.

(2) Related Art Statement

Image forming machines such as a printer system or a copying maching have been practically used which form a reproduction image on the charge image retentive member such as photosensitive member or insulating dielectric film through the formation of electrostatic latent images. According to such image forming machines, the electrostatic latent image formed on the charge image retentive member is converted to a toner image by means of a developing unit and the toner image thus obtained is transferred onto a receiving medium such as a plain paper to form a visible image. On the other hand, toner remaining on the charge image retentive member after the transferring is removed by a cleaning apparatus, and then an electrostatic latent image is formed on the cleaned charge image retentive member again, thereby enabling repeated formation of images. However, the toner image cannot be completely transferred onto the recording medium in the image forming machine, development of cleaning apparatuses which can effectively remove the residual toner remaining on the charge image retentive member after transferring have been strongly demanded.

Japanese patent publication No. 50,34,340 describes a cleaner unit for removing the toner remaining on the charge image retentive member. As shown in FIG. 5, this cleaner unit comprises a plate-like cleaning blade 1 made of a rubbery elastic material. A support holder supports a base portion of the cleaning blade 1 and pushes it against a photosensitive member such that the blade is curved in a direction in which the blade approaches the photosensitive member. Thereby, an edge of the blade is press contacted upon the surface of the photosensitive member by utilizing a resilient restoring force originating from the curving of the blade. When a frictional force of the running photosensitive member and a push force of the residual toner act upon the edge portion, the blade is further curved to approach the photosensitive member and the residual toner is removed by utilizing the resilient deflection due to the curving of the blade.

In the known cleaner unit mentioned above, it must be that the plate-like elastic rubber blade is pushed against the photosensitive member such that the central portion of the blade is curved to approach the photosensitive member and the edge portion is press contacted with the surface of the photosensitive member by utilizing the resilient restoring force caused by this curving and that an acting direction of a composed force between the press contact force and the frictional force is accurately coincided with the longitudinal direction of the curved blade. For this reason, when the blade is to be set, a press contact angle and a curved amount of the blade must be accurately determined relative to the photosensitive member. Consequently, the blade-setting operation unfavorably becomes troublesome.

Further, as the frictional force acts upon the blade, the blade functions to bite the running photosensitive member, with the result that the edge portion of the blade is more strongly press contacted with the photosensitive member. Accordingly, damages upon the photosensitive member becomes greater and its use life becomes shorter due to abrasion of the photosensitive member. Owing to this, a release mechanism must be provided to free the press contact, when the system is stopped, for preventing damages upon the photosensitive member and the abrasion of the blade itself. This causes the inconvenience that the structure of the cleaner unit becomes complicated.

SUMMARY OF THE INVENTION

Therefore, an object of the present invention is to eliminate the above-mentioned problems encountered by the prior art cleaner unit.

More particularly, the object of the present invention is to provide a cleaning apparatus which can reliably remove a developer attached on various kinds of charge image retentive members including a photosensitive member by a relatively small press contact force and enables a cleaning blade to be relatively easily set.

Further, the another object of the invention is to provide a cleaning apparatus which can prevent the residual toner scraped by the cleaning blade scattering out via the side end of the cleaning blade and is preferable for a face-down type printer system.

According to the present invention, there is a provision of a cleaning apparatus for removing residual toner attached to a charge image retentive member, comprising an elastic cleaning blade extending beyond a recording region of said charge image retentive member and arranged at a location where the charge image retentive member runs substantially vertically from upper side to lower side, said cleaning blade having a resilient leg portion and an elastically deformable edge portion formed at one end of said resilient leg portion, said edge portion having a cleaning edge which projects toward the charge image retentive member and is adapted to be brought into contact with the surface of the charge image retentive member;

a supporting member for supporting the leg portion at the other end which situates at a downstream position viewed in the running direction of the charge image retentive member; and a pair of elastically deformable side seal members arranged on an upper surface of the cleaning blade which defines said cleaning edge, at locations beyond the image recording region of the charge image retentive member, whereby the toner scraped off by the cleaning blade from the charge image retentive member is brought apart from the charge image retentive member.

According to the present invention, since the elastic edge which constitutes a cleaning line upon contact with the surface of the charge image retentive member to which is attached the residual toner projects toward the charge image retentive member the resilient leg portion is curved in a direction apart from the charge image retentive member by the frictional force acting upon the cleaning edge, so that a resilient repulsion is stored mainly in the resilient leg portion by this curving. On the other hand, when the toner on the charge image retentive member contacts with the edge portion, a push force acts upon the blade in a running direction of the charge image retentive member. At this time, the resilient leg portion is further curved by the push force of the toner so that such a greater resilient repulsion as to repulse the residual toner substantially reversely to the running direction of the charge image retentive member is stored mainly in the resilient leg portion. The residual toner can be effectively scraped off from the surface of the charge image retentive member by this resilient repulsion.

Further, according to the present invention, the cleaning blade is arranged in a location where the charge image retentive member runs substantially vertically from the upper side to lower side, and a pair of elastically deformable side seal members are arranged on the upper surface of the cleaning blade which defines the cleaning edge, at the locations beyond the image recording region of the charge image retentive member. While the residual toner scraped off by the cleaning blade accumulates on the upper surface of the edge portion, which extends along the recording region and the accumulating toner has a tendency to spread toward the both side end of the upper surface gradually. Thus it scatters out via the side edge of the cleaning blade and pollutes the surrounding members. For this purpose, according to the invention, a pair of elastically deformable side seal members are arranged on the upper surface, at the locations beyond the recording region of the charge image retentive member. The toner moving toward the side edges of the upper surface is led into a cleaner box by means of the side seal members, and thus the toner scattering can be prevented effectively. Further grooves or slots may be formed in the upper surface to lead the accumulating toner on the supper surface into the cleaner box speedily. In this case, it is extremely favorable for a cleaning apparatus in use for a printer system in which the charge image retentive member runs vertically from upper side to lower side.

These and other objects, advantages and features of the present invention will be appreciated upon reading of the following description of the invention when taken in conjunction with the attached drawings with the understanding that some modifications, variations and changes of the same could be made by the skilled person in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein.

Figure 3A:
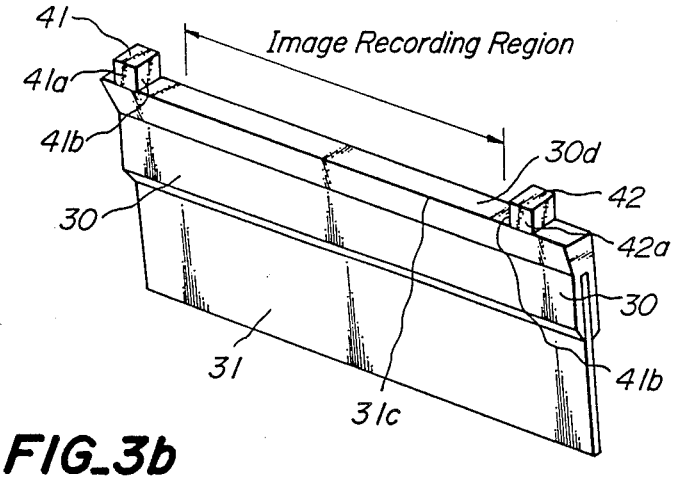
Figure 3B:
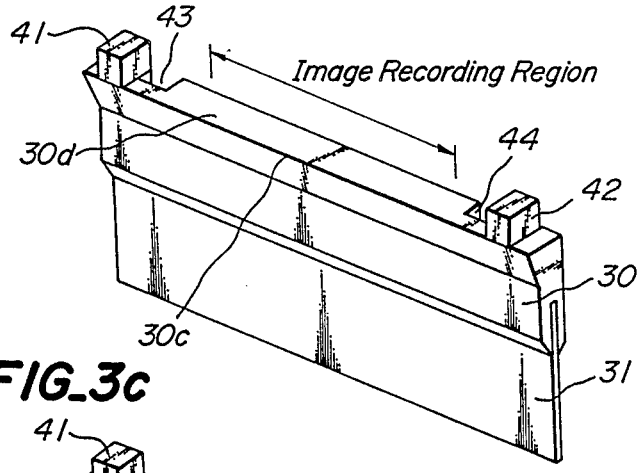
Figure 3C:
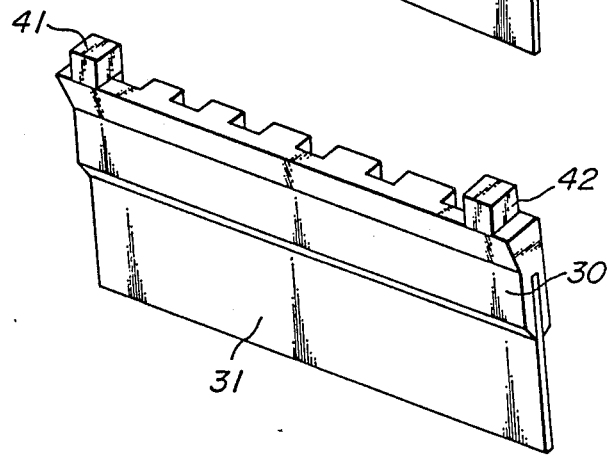
Figure 4A:
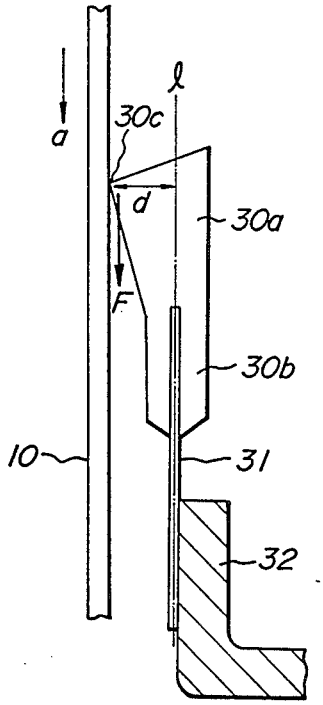
Figure 4B:
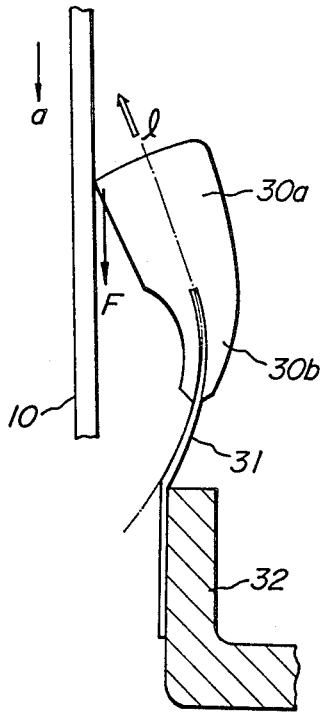
Figure 5:
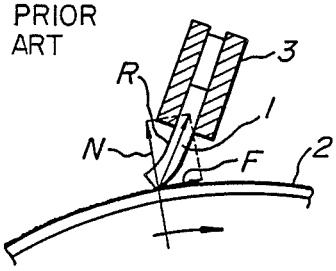
FIG 5 PRIOR ART

FIGS. 3*a*, 3*b* and 3*c* are perspective views illustrating the external configurations of the cleaning blade according to the present invention;

FIGS. 4*a* and 4*b* are diagrammatical views illustrating the state of a force acting upon the cleaning blade; and FIG. 5 is a diagrammatical view illustrating the construction of a prior art cleaner unit.

DETAILED DESCRIPTION OF THE PREFERRED EMBODIMENTS OF THE PRESENT INVENTION

Figure 1:
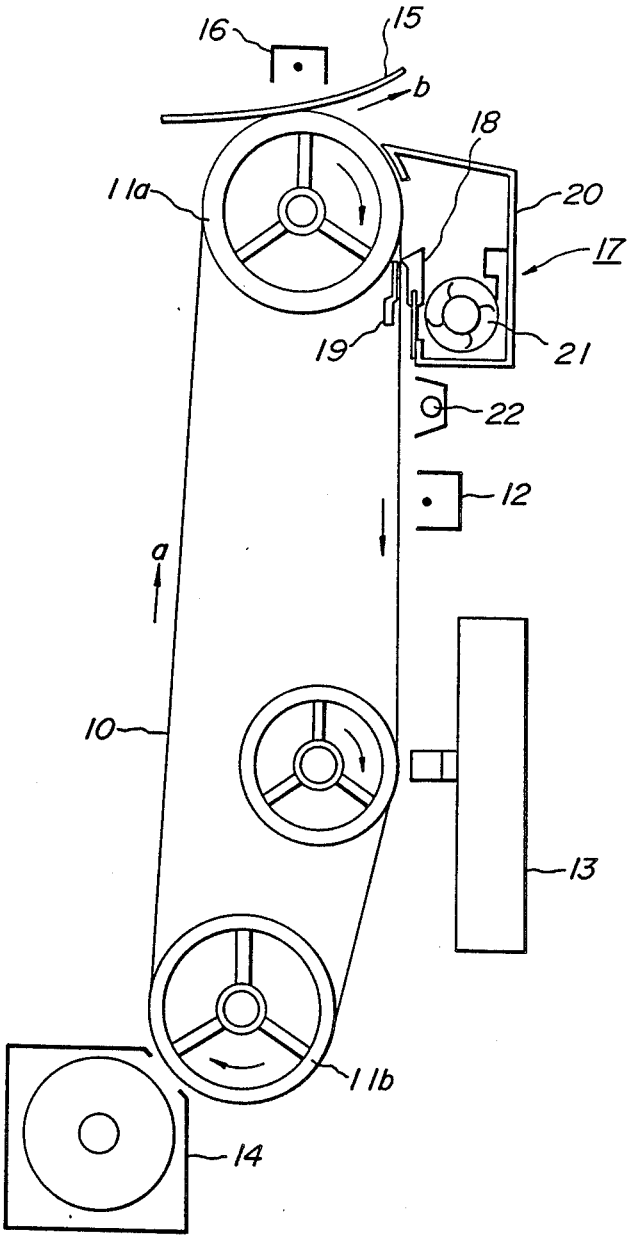
FIG. 1 is a diagrammatic view illustrating an embodiment of an image-forming unit of a printer system equipped with the cleaner unit according to the present invention.

In FIG. 1 is diagrammatically illustrated the construction of an embodiment of an image-reproduction unit of a printer system which is equipped with the cleaner unit according to the present invention. In this embodiment, a belt type photosensitive member having a predetermined recording region is used as the charge image retentive member. The photosensitive belt 10 is run in a direction of an arrow "a" extending between two drive rollers 11*a* and 11*b* which are vertically arranged opposite to each other. The photo-sensitive belt 10 is charged to a given potential voltage over its entire surface by means of a corona charger 12, after which the charged photosensitive belt 10 is exposed by an exposure unit 13, and an electrostatic latent image is formed on the photosensitive belt 10. The exposure unit 13 may be a light-emitting diode array in which a number of light-emitting diodes are linearly arranged over the recording width (in a vertical direction with respect to a paper surface). The electrostatic latent image formed on the photosensitive belt 10 is moved to a developing station where a toner image is formed upon development of the latent image by a developer unit 14. Then, the thus formed toner image is moved to a transfer station where the toner image is transferred to a recording paper 15, which is fed in synchronization with the movement of the toner image, by means of a transfer charger 16 arranged behind the recording paper. After the transferring, the recording paper is carried in a direction of an arrow "b", and is discharged outside the printer in a face-down state through a fusing unit (not shown). On the other hand, since the non-transferred toner remains on the surface of the photosensitive belt 10 having undergone the transferring step, the non-transferred toner is removed by means of a cleaner unit 17. The cleaner unit 17 comprises a cleaning blade 18 which extends beyond the recording width of the photosensitive belt 10. While a tip edge of the cleaning blade 18 is press contacted with the running photosensitive belt 10, a restraint plate 19 is arranged on the rear side of the photosensitive belt 10. By so constructing, the residual non-transferred toner is scraped off from the running photosensitive belt 10. The scraped toner is transferred sideward of the cleaner unit 17 by means of a screw roller 21 which is arranged in a housing 20. The charges retained on the toner-free photosensitive belt 10 are uniformly dissipated down to a predetermined potential by an erase lamp 22. Then, the image-reproducing operation is repeatedly performed. As mentioned above, since the transferring step is carried out at the vertical top portion of the image-reproduction unit, the recording paper is discharged in a face-down state through an almost linear passage after the transferring, thereby advantageously simplifying the transporting passage for the recording papers.

Figure 2:
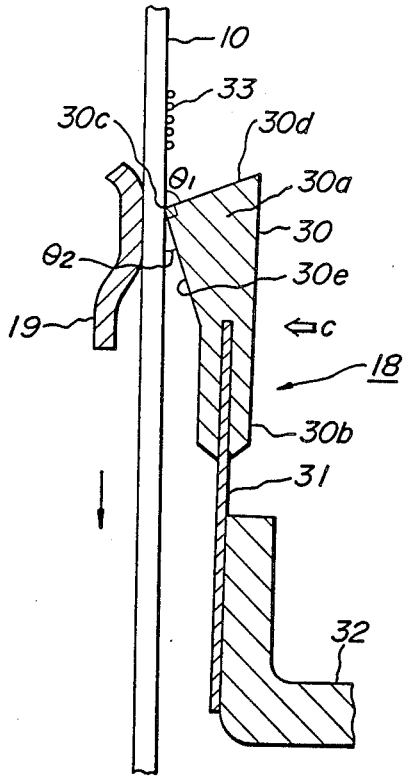
FIG. 2 is a diagrammatically sectional view illustrating the detailed construction of the cleaning blade in the present invention.

FIG. 2 is a sectional view illustrating the detailed construction of the cleaning blade. The cleaning blade 18 has an elastically deformable tip 30 extending over the recording width of the photosensitive belt 10 and a resilient supporting member 31 supporting the tip 30. The resilient supporting member 31 is supported by a printer body through a holder 32 at one end. The elastically deformable tip 30 has an elastic edge portion 30*a* of a substantially triangular section profile and a resilient leg portion 30*b* extending almost in paralle with the photosensitive belt 10. The other end portion of the plate-like resilient supporting member 31 is buried in the resilient leg portion 30*b* along its entire length. The elastic tip 30 is constituted by a rubbery resilient material such as urethane rubber, nitrile rubber, neoprene rubber, silicon rubber, natural rubber, or the like. An elastic material having a rubber hardness (JIS) in a range of 30° to 90° is used therefor. The elastically deformable edge 30*c* of elastic edge portion 30 to be contacted with the photosensitive belt 10 is an edge of substantially 90° defined by two faces 30*d* and 30*e*. An angle $\theta_1$ defined between the rearward face as viewed in the running direction of the photosensitive belt 10 from the cleaning line 30*c* and the face 30*d* of the elastic tip 30 is set at 67°, while an angle $\theta_2$ defined between the face on the forward side of the photosensitive belt 10 and the face 30*e* of the elastic tip is set at 23°. The edge 30*c* is projected toward the photosensitive belt 10 apart from the longitudinal axis of the resilient leg portion 30*b*.

The resilient supporting member 31 is made of a resilient sheet material such as a phosphor bronze plate, a stainless plate or a resilient plastic plate. While one end of the resilient supporting member 31 is secured to the holder 32, it extends substantially in parallel with the photosensitive belt 10 from the rearward side to the forward side in the running direction thereof. The elastic tip 30 is attached to the other end of the resilient supporting member 31. Therefore, the cleaning blade is supported on the forward side of the cleaning line 30*c* of the photosensitive belt 10. The holder 32 is located and fixed at a predetermined location orthogonal to the image-forming face of the photosensitive belt 10. The edge 30*c* of the elastic tip 30 is press contacted with the photosensitive belt 10 by utilizing a resilient restoring force developed mainly in the resilient leg portion 30*b* and the resilient supporting member 31 in a direction of an arrow "c". Since the restraint plate 19 is opposed to the elastic tip 30 on the opposite side of the photosensitive belt 10, the running photosensitive belt 10 is located and restrained in a position orthogonal to the running direction thereof by the restraint plate 19, so that the elastically deformable edge 30*c* of the elastic edge portion 30*a* is press contacted with the image-forming surface of the running photosensitive belt 10. As a result, the residual toner attached to the image-forming surface of the photosensitive belt 10 is scraped off by the tip edge portion 30*a* of the elastic tip 30. The scraped toner collects at the upper face 30*d* of the elastic edge portion 30*a*. However, as an amount of the collecting toner increases, the toner gradually moves on the face 30*d* in a direction leaving the photosensitive belt and finally falls in the housing 20. In this way, since the cleaning blade is supported on the forward side of the cleaning line, the scraped toner is speedily discharged even in the case that the photosensitive belt 10 runs downwardly in a vertical direction. In particular, if the cleaning blade which extends in the parallel with the running photosensitive belt is supported at the rearward side, the scraped toner accumulates between the photosensitive belt and the cleaning blade to cause an unfavorable result.

FIGS. 3*a*, 3*b* and 3*c* are perspective views illustrating the external configuration of the cleaning blade according to the present invention. In printer system it is generally necessary to discharge the recording paper in a face-down state (the recording face is directed downwardly). In the face-down type printer system, it is the most ideal design to arrange the transfer station on the top of the running path of the charge image retentive member. In the most ideal design, the cleaning apparatus is required to be arranged at the location where the photosensitive belt runs from upper side to lower side, in which case the residual toner scraped by the cleaning blade once accumulates on the upper surface 30*d* which defines the elastic edge 30*c*. Since the accumulating toner has a tendency to spread toward the side end of the cleaning blade, it is necessary to collect the accumulating toner on the upper surface 30*d* into the cleaner box before it reaches to the side end of the upper surface. For this end according to the present invention, as shown in FIG. 3*a* a pair of elastically deformable seal member 41 and 42 are arranged on the upper surface 30*d*, at the location beyond the recording width of the photosensitive belt 10. The seal members 41 and 42 are made of elastically deformable rubbery material and are provided on the upper surface 30*d* in such way that they contact with the surface of the photosensitive belt 10. According this construction, even the accumulating toner on the upper surface 30*d* spreads sideways, it may be led to rearward of the cleaning blade along the inside surfaces 41*b* and 42*b* of the seal members 41 and 42 and can rapidly fall and collect into the cleaner box 20 through the rear face of the blade 18. Further, in order to recover the toner accumulating on the upper surface 30*d* more rapidly, cut or dent portion 43 and 44 may be formed in the upper surface 30*d* inside the seal member 41 and 42 as shown in FIG. 3*b*. By forming the cut portions or grooves 43 and 44, the toner accumulating inside the seal member 41 and 42 may be speedily led to the cleaner box 20 through the cut portion, so that the toner spreading toward the side end of the blade can be effectively prevented from over-accumulating inside the seal members and scatter outside over the seal member. As shown in FIG. 3*c*, a number of cut portions may be formed in the upper surface 30*d*. Further, the seal members 41 and 42 may be integrally consisted with cleaning blade or separately constituted therefrom. In the case of the latter separated construction, the seal members may be fixed directly to the cleaning blade with an adhesive or may be fixed to the cleaner box.

FIGS. 4*a* and 4*b* are views illustrating the state in which the cleaning blade is contacted with the surface of the running photosensitive belt. First, when the cleaning blade is to be set, the elastic edge portion 30*a* is slightly pushed against the photosensitive belt 10, and the edge 30*c* is press contacted with the photosensitive belt 10 by utilizing the resilient restoring force of the edge portion 30*a*, the resilient leg portion 30*b* and the resilient supporting member 31. At that time, such a magnitude of the press contact force is sufficient that can produce an appropriate frictional force F between the photosensitive belt 10 and the edge 30*c*. Thus, the edge portion can be press contacted with the photosensitive belt by utilizing mainly the resilient restoring force developed in the elastic edge portion 30*a* so that bending amounts of the resilient leg portion 30*b* and the resilient supporting member 31 can be reduced. In this state, when the photosensitive belt 10 is run in the arrow "a" direction. The frictional force F determined by a coefficient of friction between the elastic deformable edge portion 30*a* and the surface of the photosensitive member acts upon the edge 30*c* together with the press contact force acting thereon. On the other hand, while the edge 30*c* projects toward the photosensitive belt by a distant "d" relative to the longitudinal axis "e" of the resilient leg portion 30*b* and the resilient supporting member 31, the other end of the resilient supporting member 31 is fixed to the holder 32. Accordingly, the frictional force F acts upon the edge 30*c* as a moment for counterclockwise deplacing the resilient movable portion of the blade around a fixing point of the supporting member. Consequently, as shown in FIG. 4*b*, the elastic edge portion 30*a*, the resilient leg portion 30*b* and the resilient supporting member 31 are slightly curved by this frictional force apart from the photosensitive belt 10, so that a resilient bending force is stored mainly in the elastic leg portion 30*b* and the resilient supporting member due to this curving. This resilient bending force becomes the resilient restoring force to strongly press contact the edge 30*c* against the photosensitive belt 10. Since the residual toner is attached onto the photosensitive belt 10 by the electrostatic force, the push force which pushes the elastic edge portion 30*a* in the running direction of the photosensitive member acts when the residual toner contacts with the resilient edge portion. However, even when the push force acts upon the edge portion by the residual toner, the resilient leg portion 30*b* and the resilient support member 31 are curved to offset the push force of the residual toner and a greater resilient repulsion is stored to repulse the residual toner reversely in the running direction of the photosensitive member. Thereby, the residual toner can be effectively scraped off by the edge 30*c*, which is press contacted with the surface of the photosensitive belt.

The larger the coefficient of friction of the elastic rubbery material constituting the elastic edge portion is, the greater is a curved amount produced mainly in the resilient leg portion, while the smaller the rubber hardness, the larger the curved amount. Further, when a material easy to bend is used for the resilient supporting member, this curved amount becomes larger. Therefore, the rubbery material and the shape of the cleaning blade are appropriately selected so that it may be properly curved and displaced based on the coefficient of friction and the rubber hardness of the resilient rubbery material and the modulus of elasticity of the elastic material constituting the resilient leg portion. By so constructing, when the edge 30*c* is merely contacted with the surface of the photosensitive belt by a relatively weak press contact force, the edge 30*c* can be assuredly press contacted with the surface of the photosensitive belt. Thus, the photosensitive belt is not damaged and the abrasion of the blade itself can be prevented. Further, since resilient leg portion and the resilient supporting member have only to be slightly bent on setting the blade, the blade-setting operation is made easy. In addition, since the resilient leg portion 30*b* and the resilient supporting member 31 are arranged in parallel with the running direction of the photosensitive belt, the cleaner box can advantageously be made narrower in the width direction thereof as compared with a case where a blade is set at a certain press contact angle.

In the illustrated embodiment, the angle $\theta_1$ defined between the face 30*d* with which the residual toner contacts and the photosensitive belt 10 is set at 67°. However, if $\theta_1$ is too small, the toner easily passes through the edge 30*c*, while if $\theta_1$ is too large, the strength of the resilient edge portion cannot be maintained. Thus, it is preferable that the angle $\theta_1$ is set at a range from 50° to 110°. The angle $\theta_2$ defined between the face 30*e* opposed to the photosensitive belt and the photosensitive belt is set at 23°. However, if $\theta_2$ is too large, the strength of the resilient edge portion 30*a* becomes lower. Thus, it is preferable that $\theta_2$ is set at a range from 7° to 45°.

The present invention is not limited to the above-explained embodiments, but a variety of modifications and changes can be of course made. For instance, although the embodiments have been explained which are applied in the image-forming unit of the printer system, the cleaning apparatus according to the present invention is not limited to the printer system only, and can be applied to various kinds of image-reproduction apparatus such as copying machines, etc.

Finally, effects obtained by the above-explained invention are summarized as follows:

1. Since the edge constituting the cleaning line upon contact with the surface of the photosensitive belt projects toward the photosensitive belt apart from the central axis of the resilient leg portion, the resilient leg portion is curved in a direction apart from the photosensitive belt by the frictional force acting upon the edge, and a resilient repulsion is stored by the curving and displacement. When the residual toner contacts with the edge, the push force acts upon the blade from the toner along the running direction of the photosensitive belt. At that time, mainly the resilient leg portion is further curved owing to the push force of the residual toner, so that the greater resilient repulsion is stored to repulse the residual toner reversely in the running direction of the photosensitive belt. Thus, the residual toner can be effectively scraped off from the surface of the photosensitive belt by the resilient repulsion.

2. When the cleaning blade is set, the resilient leg portion can be curved owing to the effective frictional force which is produced merely by lightly pushing the blade against the photosensitive belt. Therefore, the press contact force acting upon the edge portion can be lowered so that the abrasion of the photosensitive member and the blade can be reduced. In particular, a press contact release mechanism for the blade is made unnecessary.

3. When the blade is set, it is almost unnecessary to curve the blade itself, and the edge portion has only to be slightly pushed against the photosensitive member. Thus, the blade-setting operation is facilitated.

4. Since the resilient leg portion is supported substantially in parallel with the running direction of the photosensitive belt, the press contact force can be substantially vertically exerted upon the surface of the photosensitive belt. Thus, the setting operation can be further facilitated.

5. Since the cleaning blade is supported on the forward side of the running direction of photosensitive belt, the scraped toner can be speedily removed without a large amount of the toner being collected. Particularly, since the recording papers need to be discharged outside the printer in the face-down state (the recording face is directed downwardly), it is preferable to effect the transferring step at the vertical top side of the image-reproduction unit. In this case, since the cleaner unit is required to be arranged in a location where the photosensitive member runs vertically from the upper side to the lower side, to support the cleaning blade forward in the running direction of the charge image retentive member is extremely favorable for removing the scraped toner.

6. Since a pair of elastically deformable seal members are provided on the upper surface on which the scraped toner accumulates, the scraped toner having a tendency to spread toward the side end of the cleaning blade can be led to the cleaner box, and thus the scraped toner can be effectively prevented from scattering outside via side end of the cleaning blade. Furthermore, since the cut portions or grooves are formed in the upper surface inside the seal member, the scraped toner may be speedily collected into the cleaner box via the grooves. Therefore, it can be prevented that the scraped toner over-accumulates inside the seal members. In this case, even if the cleaning blade is needed to be arranged at the location where the charge image retentive member runs vertically from upper side to down side, the scraped toner can be collected into the cleaner box without scattering. Therefore, the cleaning apparatus according to the present invention is preferable in use for face-down type printer system.

What is claimed is:

1. A cleaning apparatus for removing residual toner from a rotatable charge image retentive member, comprising an elastic cleaning blade for scraping residual toner from a recording region of said charge image retentive member, said elastic cleaning blade extending beyond the recording region of said charge image retentive member, said elastic cleaning blade having a resilient leg portion and an elastically deformable cleaning edge projecting outward from said leg portion and toward said charge image retentive member, said cleaning edge being operative for making contact with said charge image retentive member and for removing said residual toner from said charge image retentive member onto an upper surface of said elastic cleaning blade.

an elastic supporting member for supporting said leg portion at a downstream position relative to the rotational direction of said charge image retentive member, and a pair of side seal members arranged on the upper surface of said cleaning blade, said side seal members being located beyond said recording region of said charge image retentive member, said elastic cleaning blade including openings for guiding scraped toner on the upper surface of said cleaning blade.

2. The cleaning apparatus of claim 1 wherein said side seal members are made from an elastic material.

3. The cleaning apparatus of claim 1 wherein said charge image retentive member is a photoconductive belt.

4. The cleaning apparatus of claim 1 wherein said charge image retentive member is a photoconductive belt and said elastic cleaning blade is aligned substantially parallel to said photoconductive belt when said photoconductive belt is not rotating.

5. The cleaning apparatus of claim 1 wherein said cleaning edge is substantially triangular in cross-section.

6. The cleaning apparatus of claim 1 wherein said upper surface forms an acute angle with said charge image retentive member.

7. The cleaning apparatus of claim 1 wherein an angle in the range of about 50° to 110° is formed between said upper surface of said cleaning edge and said charge image retentive member, and an angle in the range of about 7° and 45° is formed between a lower portion of said cleaning edge and said charge image retentive member.

8. The cleaning apparatus of claim 1 wherein said leg portion extends substantially parallel to a moving direction of said charge image retentive member.

9. The cleaning apparatus of claim 1 wherein said openings form a crenelated structure.

* * * * *

UNITED STATES PATENT AND TRADEMARK OFFICE

CERTIFICATE OF CORRECTION

PATENT NO. : 4,779,119

DATED : October 18, 1988

INVENTOR(S) : SHOZO KAIEDA

It is certified that error appears in the above-identified patent and that said Letters Patent is hereby corrected as shown below:

On the title page there should be added after item "[22]":

-- [30] Foreign Application Priority Data

-- Dec. 11, 1986 Japan ---- 61-293479 --

Signed and Sealed this

Twenty-third Day of May, 1989

*Attest:*

DONALD J. QUIGG

*Attesting Officer*

*Commissioner of Patents and Trademarks*